US009352442B2

(12) United States Patent
Tan et al.

(10) Patent No.: US 9,352,442 B2
(45) Date of Patent: May 31, 2016

(54) LAPPING CARRIER

(71) Applicant: Seagate Technology LLC, Cupertino, CA (US)

(72) Inventors: Kim Sek Tan, Penang (MY); Choong Kit Mah, Penang (MY); Soo Chun Loh, Penang (MY); Choon Yen Lim, Penang (MY); Chin Chong Yew, Penang (MY); Leping Li, Bloomington, MN (US); Yuik Zhi Lim, Penang (MY)

(73) Assignee: SEAGATE TECHNOLOGY LLC, Cupertino, CA (US)

( * ) Notice: Subject to any disclaimer, the term of this patent is extended or adjusted under 35 U.S.C. 154(b) by 322 days.

(21) Appl. No.: 13/933,945

(22) Filed: Jul. 2, 2013

(65) Prior Publication Data

US 2015/0007430 A1 Jan. 8, 2015

(51) Int. Cl.
*B23P 19/00* (2006.01)
*B24B 37/30* (2012.01)

(52) U.S. Cl.
CPC ..... *B24B 37/30* (2013.01); *Y10T 29/49998* (2015.01)

(58) Field of Classification Search
CPC ..... B24B 37/30; B24B 53/017; B24B 9/065; H01L 21/68721; Y10T 483/174; Y10T 29/49998
USPC ..... 29/830, 412, 414, 417, 423, 559, 593, 29/603.09, 603.1, 603.12, 603.16, 760, 29/27 C, 787, 795; 451/28, 36, 59, 262, 451/288, 365
See application file for complete search history.

(56) References Cited

U.S. PATENT DOCUMENTS 6,093,083 A 7/2000 Lackey
6,102,777 A * 8/2000 Duescher ..... B24B 37/04 451/262
6,374,479 B1 * 4/2002 Sasaki ..... G11B 5/10 29/412

FOREIGN PATENT DOCUMENTS

EP 0868976 A2 10/1998
WO WO03089192 A1 10/2003

* cited by examiner

*Primary Examiner* — Thiem Phan
(74) *Attorney, Agent, or Firm* — HolzerIPLaw, PC

(57) ABSTRACT

Implementations disclosed herein allow a printed circuit board (PCB) to be removeably secured to a lapping carrier. The lapping carrier may include a clamping mechanism and one or more alignment pins that thread through corresponding holes in the PCB. In other implementations, the lapping carrier includes insulation that prevents current leakage or short-circuiting of electrical paths on the PCB during contact with the clamping mechanism.

20 Claims, 16 Drawing Sheets

LAPPING CARRIER

BACKGROUND

Lapping is a method of planarizing a surface of a work piece (e.g., a bar sliced from a wafer) to reduce its surface topography (e.g., roughness). Such surface topography is formed, for example, when a wafer (e.g., an AlTiC wafer) is sliced into bars with uneven or rough surfaces. The bars can be mounted and polished in one or more precision lapping (i.e., polishing) processes to achieve desirable surface planarization and surface smoothness.

In one example lapping process, an electronic lapping guide (ELG) is used to accurately control the planarization of a surface of a work piece. As used herein, the term "work piece" refers to a structure, such as a bar or chunk, including one or more individual electronic components, such as microelectronic components or features. ELG sensors are embedded in a work piece with a surface to be lapped, and the work piece is attached to a lapping carrier releasably attached to printed circuit board (PCB). Connection points on the PCB are releasably bonded, via a wire bonding process, to one or more electronic lapping guide (ELG) bonding pads on the work piece. While the work piece is lapped (e.g., polished), a controlled amount of current is flowed via the PCB and each of the ELG bonding pads from a lapping controller to measure, in-situ and real time, the resistance of each of one or more ELG sensors electrically coupled to the ELG bonding pads. The resistance of each ELG sensor increases as the thickness of the work piece proximal to each of the ELG sensors decreases. Consequently, the change in the thickness of the work piece can be measured and the measurement is used to actively control lapping parameters during the lapping process. For example, such work piece thickness measurements can be used to selectively control the rate at which material is removed at different positions on the work piece (e.g., by applying more or less pressure to different positions along a length of the work piece) during a lapping process.

SUMMARY

Implementations described and claimed herein provide for a lapping carrier that includes an alignment mechanism to align a PCB relative to a predefined position on the lapping carrier and a clamping mechanism to secure the PCB against the lapping carrier.

This Summary is provided to introduce an election of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations as further illustrated in the accompanying drawings and defined in the appended claims.

DETAILED DESCRIPTION

In one type of lapping operation, a printed circuit board (PCB) is attached to a lapping carrier and a wire bonding process is used to establish interconnections between ELG bonding pads on a work piece and corresponding bonding pads on the PCB (hereinafter "PCB bonding pads"). After the lapping operation, the wire bonds are broken, and the PCB is detached from the lapping carrier and cleaned to remove residue from the wire bonding process. Thus, one challenge in performing lapping operations is attaching the PCB to the lapping carrier in a manner that allows for such frequent attachment and detachment but is also compatible with the wire bonding process.

Adhesives (e.g., double-sided tape) may be used to attach the PCB to the lapping carrier; however, adhesives may contain corrosive chemicals that can cause corrosion of the work piece. Additionally, removing adhesive tape can create electrostatic discharge (ESD) on the lapping carrier and leave behind adhesive residue that contaminates the work piece and necessitates excess cleaning steps. Implementations described herein provide mechanisms for easily, reliably, and precisely attaching or detaching a PCB to or from a lapping carrier without causing contamination, corrosion, or ESD.

Implementations of the lapping carrier technology disclosed herein may be generally applicable in lapping processes and systems used in conjunction with many types of work pieces, including without limitation, read/write heads suitable for use in hard drive devices.

Figure 1:
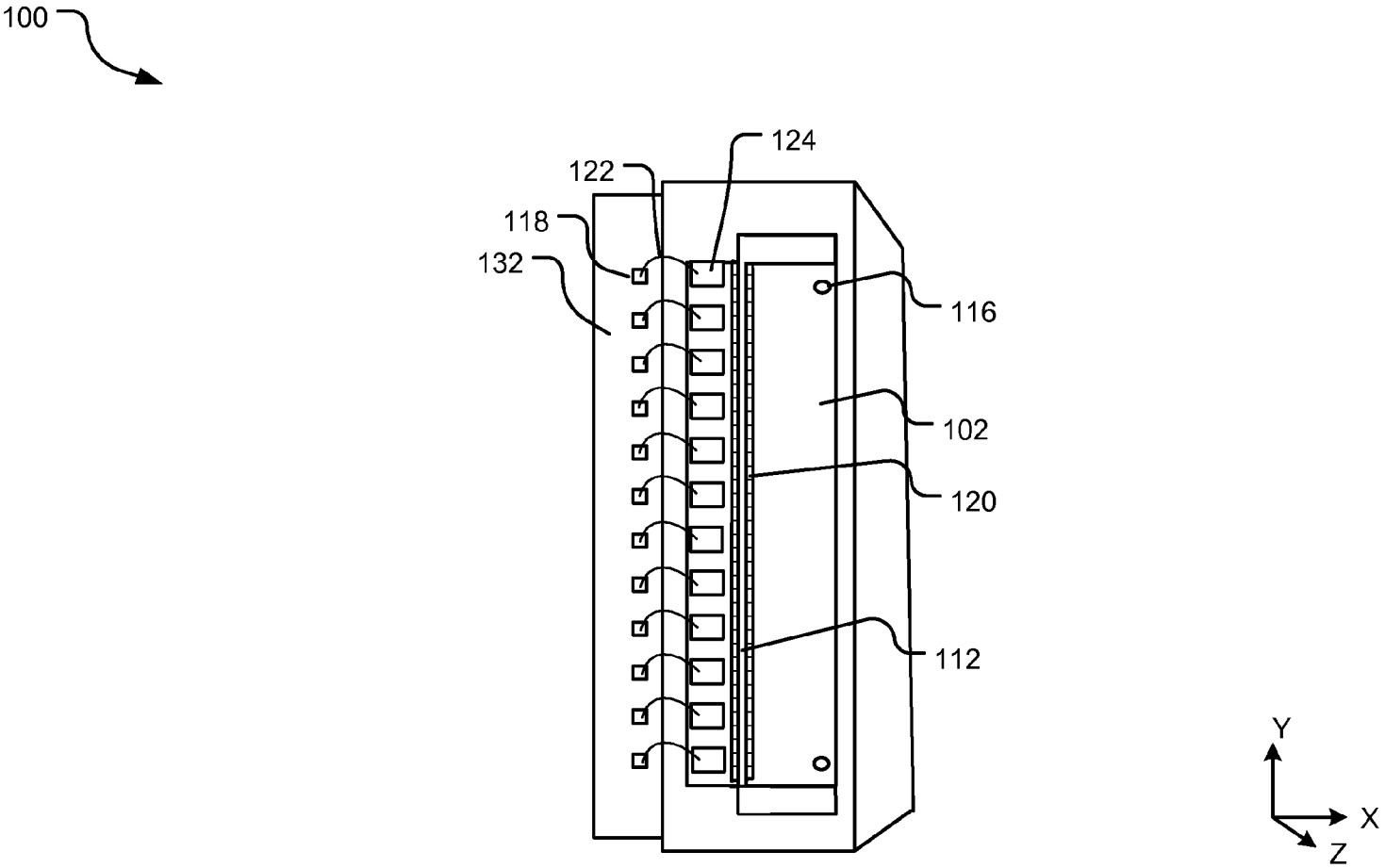
FIG. 1 illustrates a work piece mounted to an example lapping carrier.

FIG. 1 illustrates a side view of an example lapping carrier 100 that includes a work piece 132 bonded, via a number of wire bonds (e.g., a wire bond 122) to a printed circuit board (PCB) 102. The lapping carrier 100 is used to obtain an accurately planarized and highly smooth (e.g., sub-nanometer variations) surface on the work piece 132. In one implementation, the work piece 132 is a rectangular bar sliced from an AlTiC wafer with read/write sensors formed thereon.

The work piece 132 also includes a number of ELG bonding pads (e.g., an ELG bonding pad 118), which provide electrical connections to ELG sensors (not shown) embedded within the work piece 132. Each of the ELG bonding pads on the work piece 132 is shown releasably bonded (via a trace or wire bond 122) to a corresponding PCB bonding pad (e.g., a PCB bonding pad 124) on the PCB 102. The PCB bonding pads provide an electrical connection to the PCB 102, which in turn may connect to a lapping control unit (not shown) that monitors and adaptively controls lapping operations on the work piece 132 in-situ and in real time.

The PCB 102 is secured to the lapping carrier 100 using a clamping mechanism 112. The clamping mechanism 112 applies pressure across a length or an area of the PCB 102 sufficient to hold the PCB 102 flat, preventing the PCB 102 from warping in a manner that may interfere with the wire bonding process. A protective strip 120 on the PCB 102 serves as a landing site for the clamping mechanism 112, preventing the clamping mechanism 112 from directly contacting fragile electrical paths of the PCB 102. The protective strip 120 may be, for example, a strip of electrically insulating material.

An alignment mechanism 116 aligns the PCB 102 for the wire bonding process and secures the PCB 102 from lateral movement (e.g., movement in the X-Y plane) during a subsequent lapping process. Although other alignment mechanisms are contemplated, the alignment mechanism 116 is an alignment pin threaded through a corresponding hole in the PCB 102.

The PCB 102 can be secured to the lapping carrier 100 by opening the clamping mechanism 112, aligning the PCB 102 using the alignment mechanism 116, positioning the aligned PCB 102 on the lapping carrier (as illustrated), and closing the clamping mechanism 112. Unlike adhesive tape, which must be peeled and removed from the lapping carrier 100 between lapping processes, the clamping mechanism 112 does not leave behind corrosive residue, any form of contamination, or the potentially damaging electrostatic discharge (ESD) that is associated with the use of adhesive tape.

Figure 2:
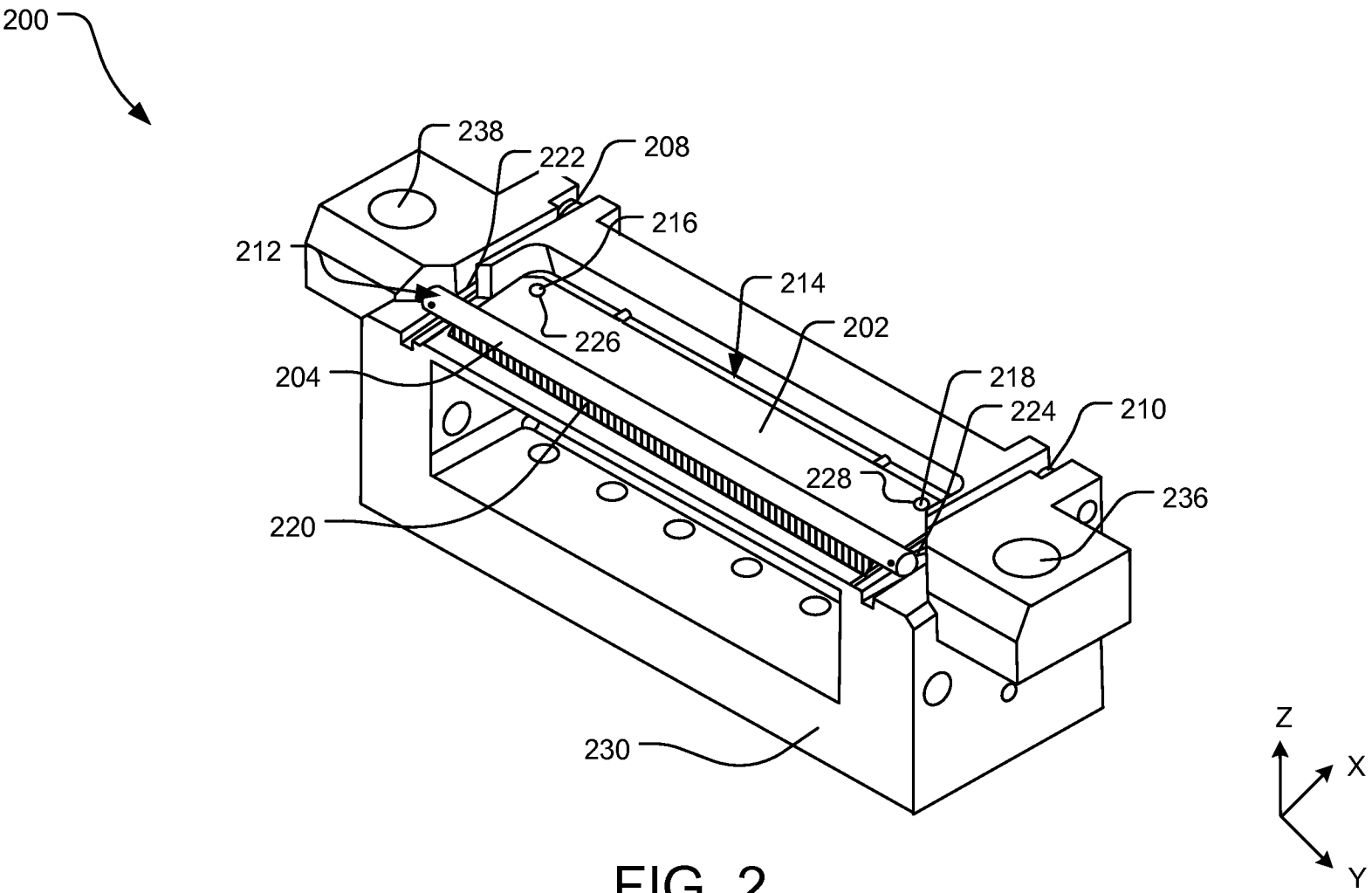
FIG. 2 illustrates a printed circuit board (PCB) attached to another example lapping carrier.

FIG. 2 illustrates a printed circuit board (PCB) 202 attached to an example lapping carrier 200 with a clamping mechanism 212. The PCB 202 is releasably attached, via the clamping mechanism 212, to a surface 214 of the lapping carrier 200. A work piece (not shown) can be mounted on or positioned proximal to the lapping carrier 200 and undergo a wire bonding process that bonds one or more ELG bonding pads on the work piece to corresponding PCB bonding pads (not shown) on the PCB 202.

The lapping carrier 200 includes alignment pins 216 and 218. In the implementation shown, the alignment pins 216 and 218 are cylindrical protrusions from the adjacent surface 214 of the lapping carrier 200, each sized and shaped to thread within a corresponding hole (i.e., holes 226 and 228, respectively) in the PCB 202. An alignment achieved via the alignment pins 216 and 218 and corresponding holes 226 and 228 (e.g., the alignment illustrated in FIG. 2) allows for the formation of the delicate wire bonding connections between PCB 202 and the work piece.

Threading the alignment pins 216 and 218 through the corresponding holes 226 and 228 in the PCB 202 may also prevent the PCB 202 from shifting laterally (i.e., in a direction parallel to the adjacent surface 214) during the lapping process. Although two alignment pins 216 and 218 are illustrated, any number (e.g., one or more) of such pins is contemplated.

The clamping mechanism 212 includes a clamping rod 204 and supporting elements 222 and 224 that that can be moved between a first, closed position (as illustrated) and a second, open position (not shown). The clamping rod 204 is an elongated bar or rod that extends between proximal ends of the supporting elements 222 and 224. In the example implementation, the supporting elements 222 and 224 each have a longitudinal axis substantially perpendicular to the longitudinal axis of the clamping rod 204. A distal end of each of the supporting elements 222 and 224 is movably fastened to a body 230 of the lapping carrier 200 in a manner that allows the supporting elements 222 and 224 to pivot from a first position substantially parallel to the surface 214 (e.g., when the clamping rod 204 is in the closed position) to a second position, wherein the supporting elements 222 and 224 are non-parallel to the surface 214 (e.g., when the clamping rod 204 is in the open position). The clamping rod 204 and/or other components of the clamping mechanism may be made of a hard material such as, for example, stainless steel. In one implementation, the supporting elements 222 and 224 are stainless steel arms pressed down by a torsion spring. In another implementation, the supporting elements 222 and 224 are spring plates.

Torsion springs 208 and 210 secure the PCB 202 against the body 230 of the lapping carrier 200. When a force is applied to the clamping rod 204 in a direction away from the PCB 202 (e.g., the upward, positive z-direction), the torsion springs 208 and 210 compress, allowing the clamping rod 204 to be moved to the open position. Such force may be applied, for example, by sliding a device under the clamping rod 204, which forces the clamping rod 204 away from the PCB 202. In one implementation, a wedged device is used to pry the clamping rod 204 away from the surface of the PCB 202.

Other implementations may employ a variety of other mechanisms to moveably secure clamping rod 204 to the lapping carrier 200. Such mechanisms include, without limitation, spring plates, mechanical latches, mechanical switches, and mechanical toggles, such as toggles that clamp down on the PCB 202 to hold the PCB 202 in place.

A protective strip 220 serves as a landing site for the clamping rod 204. In FIG. 2, the protective strip 220 is attached to the PCB 202 and extends along the longitudinal axis of the PCB 202 and between opposite ends of the PCB 202. The protective strip 220 is formed of an electrically insulating material, which prevents short-circuiting of the electrical paths on the PCB 202. As used herein, an electrically insulating material is one that has an electrical resistance high enough to prevent electrical current leakage between electrical paths on the PCB 202. Suitable material choices for the protective strip 220 include, for example, polyimide and solder mask. In one implementation, polyimide is laminated onto the PCB 202 and cured in a baking process. In another implementation, a solder mask is applied onto the PCB 202 and cured in a baking process.

In one implementation, the protective strip 220 is replaced with a coating of electrically insulating material on the clamping rod 204. The coating of electrically insulating material prevents electrical paths of the PCB 202 from directly contacting conductive components of the clamping rod 204 and/or the support elements 222 and 224. In yet another implementation, the clamping rod 204 is constructed of an electrically insulating material and is permitted to directly contact electrical paths on the PCB 202.

When the clamping mechanism is in the closed position (as illustrated) the clamping rod 204 applies pressure substantially evenly across the PCB 202 or across a sufficient length or area of the PCB 202 to hold the PCB 202 flat against the surface 214.

Different designs may employ different techniques to position the PCB 202 on the lapping carrier 200. In one example implementation, a loading jig (not shown) is used to open and close the clamping mechanism 212 during a PCB loading process. In such a process, jig supporting pins (not shown) of the loading jig may be threaded through jig holes 236 and 238 of the lapping carrier 200.

Figure 3:
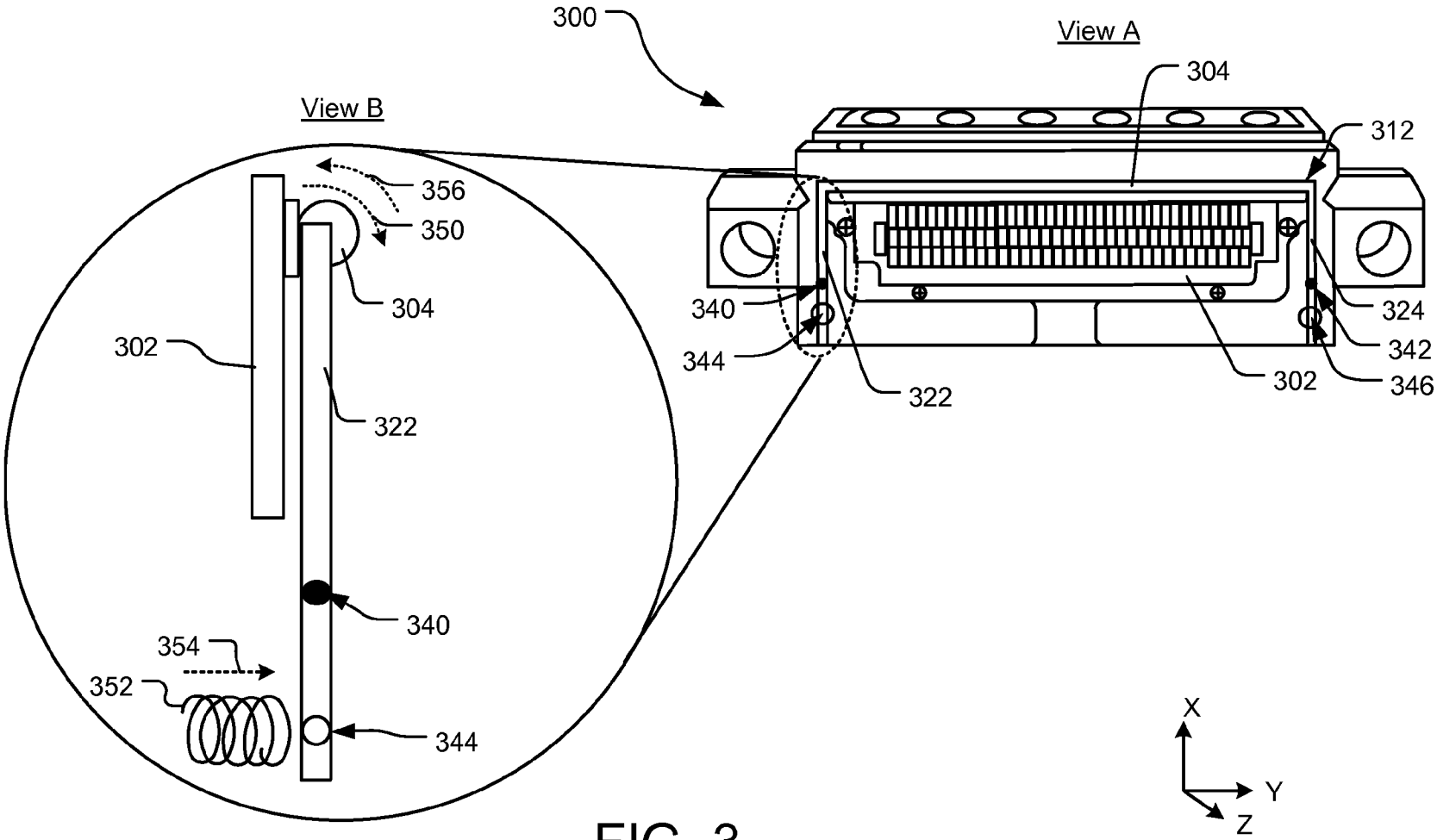
FIG. 3 illustrates a PCB attached to another example lapping carrier.

FIG. 3 illustrates a top-down view (View A) of a printed circuit board (PCB) 302 attached to an example lapping carrier 300 with a clamping mechanism 312. The PCB 302 is releasably attached, via the clamping mechanism 312 to the lapping carrier 300. The clamping mechanism 312 includes a clamping rod 304 that can be moved between a first, closed position (as illustrated) and a second, open position (not shown). The clamping rod 304 is an elongated bar or rod that extends between proximal ends of the supporting elements 322 and 324. In the example implementation, the supporting elements 322 and 324 each have a longitudinal axis substantially perpendicular to the longitudinal axis of the clamping rod 304. The supporting elements 322 and 324 are movably fastened to a body of the lapping carrier 300 at pivot points 340 and 342. The clamping mechanism 312 can be opened by applying pressure to ends of the supporting elements 322 and 324 that are distal to the clamping rod 304.

View B shows a side, cross-sectional view of the supporting element 322, clamping rod 304, and PCB 302. Such elements in View B are rotated from their respective positions in View A by 90 degrees (i.e., out of the page and in the clockwise direction). The clamping rod 304 can be moved in the direction of an arrow 350 (e.g., away from the PCB 302) by applying pressure to the pressure point 344. Such pressure compresses a compressive spring 352 and causes the supporting element 322 to rotate about the pivot point 340. Removing the pressure from the pressure point 344 allows the compressive spring 352 to expand in the direction of the arrow 354. Such expansion of the compressive spring 352 rotates the clamping rod 304 in the direction shown by arrow 356, returning the clamping rod 304 and the supporting element 322 to its original position (e.g., where the clamping mechanism is in a closed position). It may be understood that although View B illustrates the movement of the supporting element 322 about the pivot point 340, the other supporting element (i.e., the supporting element 324 shown in View A) moves similarly about the pivot point 342.

In one implementation, a plunger tool (not shown) is used to apply pressure to ends of the supporting elements 322 and 324 that are distal to the clamping rod 304 (e.g., at a pressure point 344) to rotate the supporting elements 322 and 324 about the pivot points 340 and 344, respectively.

In yet another implementation, a tension spring (not shown) may be used in conjunction with each of the supporting elements 322 and 324 instead of compressive springs (e.g., the compressive spring 352). Each tension spring may be located, for example, along an axis of an associated supporting element 322 or 324 and between the associated pivot point 340 or 342 and the clamping rod 304. The tension spring may, for example, apply force in the direction opposite the arrow 354, pulling the associated supporting element to the closed position. In such implementation, applying pressure at the pressure point 344 adds tension to the tension spring, opening the clamping mechanism 312. Releasing the pressure form the pressure point 344 releases the tension from the tension spring, allowing the clamping mechanism 312 to return to a closed position (e.g., to pressure points 344 and 346). In another implementation, torsion springs are used at the pivot points 340 and 342.

Figure 4:
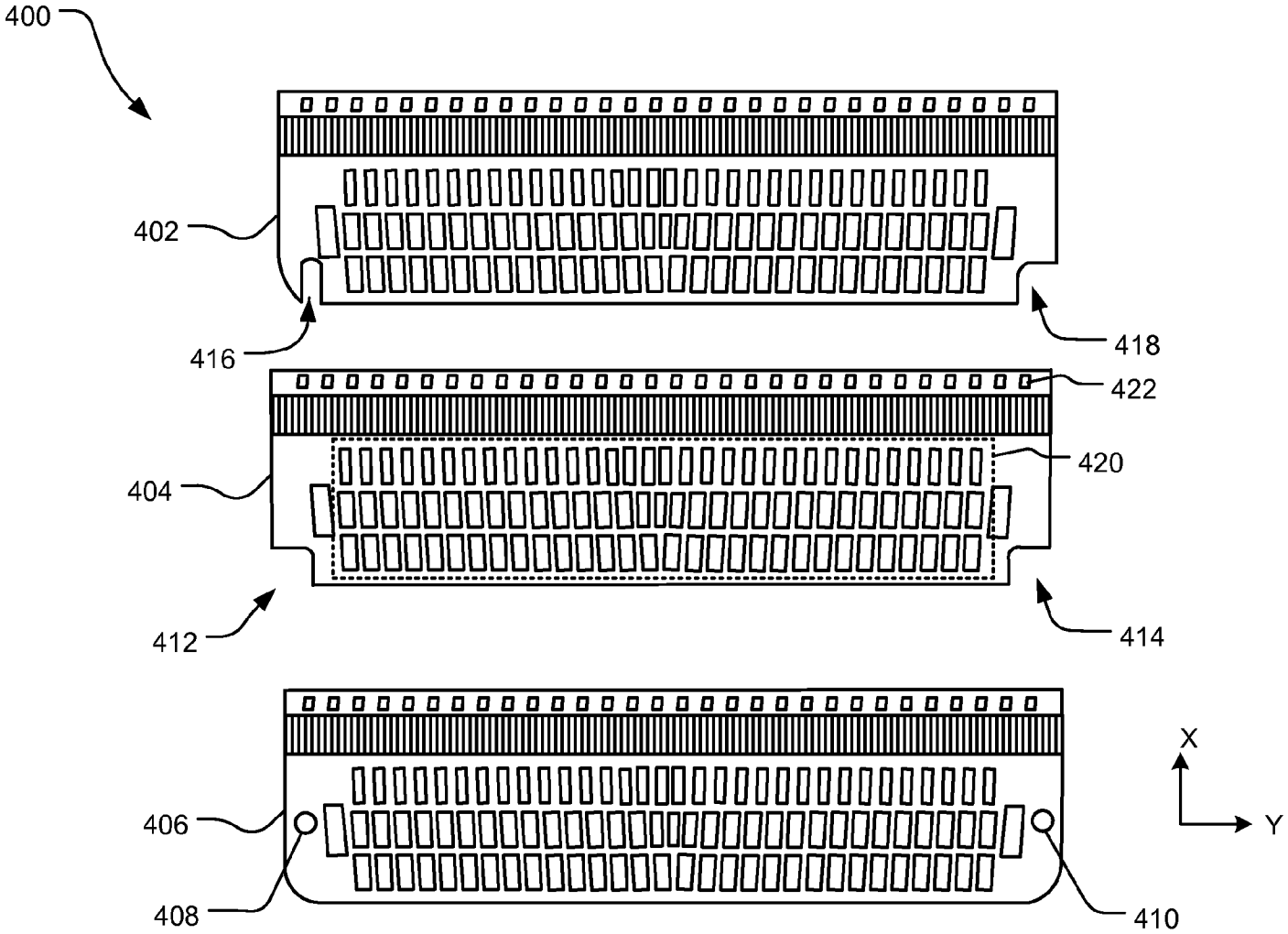
FIG. 4 illustrates different example PCBs each having an example alignment mechanism suitable for use on a lapping carrier.

FIG. 4 illustrates different example PCBs 402, 404, and 406, each having an alignment mechanism suitable for use in a lapping carrier. In particular, each of the PCBs 402, 404, and 406 includes two holes or notches for receiving corresponding alignment pins on a lapping carrier. Accordingly, the term "alignment holes" is used herein to refer to both holes and notches used in alignment processes. The PCB 406 includes a set of round alignment holes 408 and 410; the PCB 404 includes a set of L-shaped alignment holes 412 and 414; and the PCB 402 includes a U-shaped alignment hole 416 and an L-shaped alignment hole 418. Any number of such holes, shapes, or combinations of shapes implemented on the same PCB is contemplated.

On each of the PCBs 402, 404, and 406, the alignment holes are positioned proximal to opposite edges along the longitudinal axis of the corresponding PCB. Thus, the alignment holes do not interfere with circuitry (e.g., circuitry 420) or bonding pads (e.g., a bonding pad 422) on the PCBs. In other implementations, the alignment holes are positioned in other positions on the PCB. In one implementation, the PCBs are manufactured with an increased width along the longitudinal axis to create space for alignment holes on opposite sides of the circuitry or bonding pads (see, e.g., FIG. 6, which includes a PCB with increased width to provide space for alignment pins 616 and 618).

Figure 5:
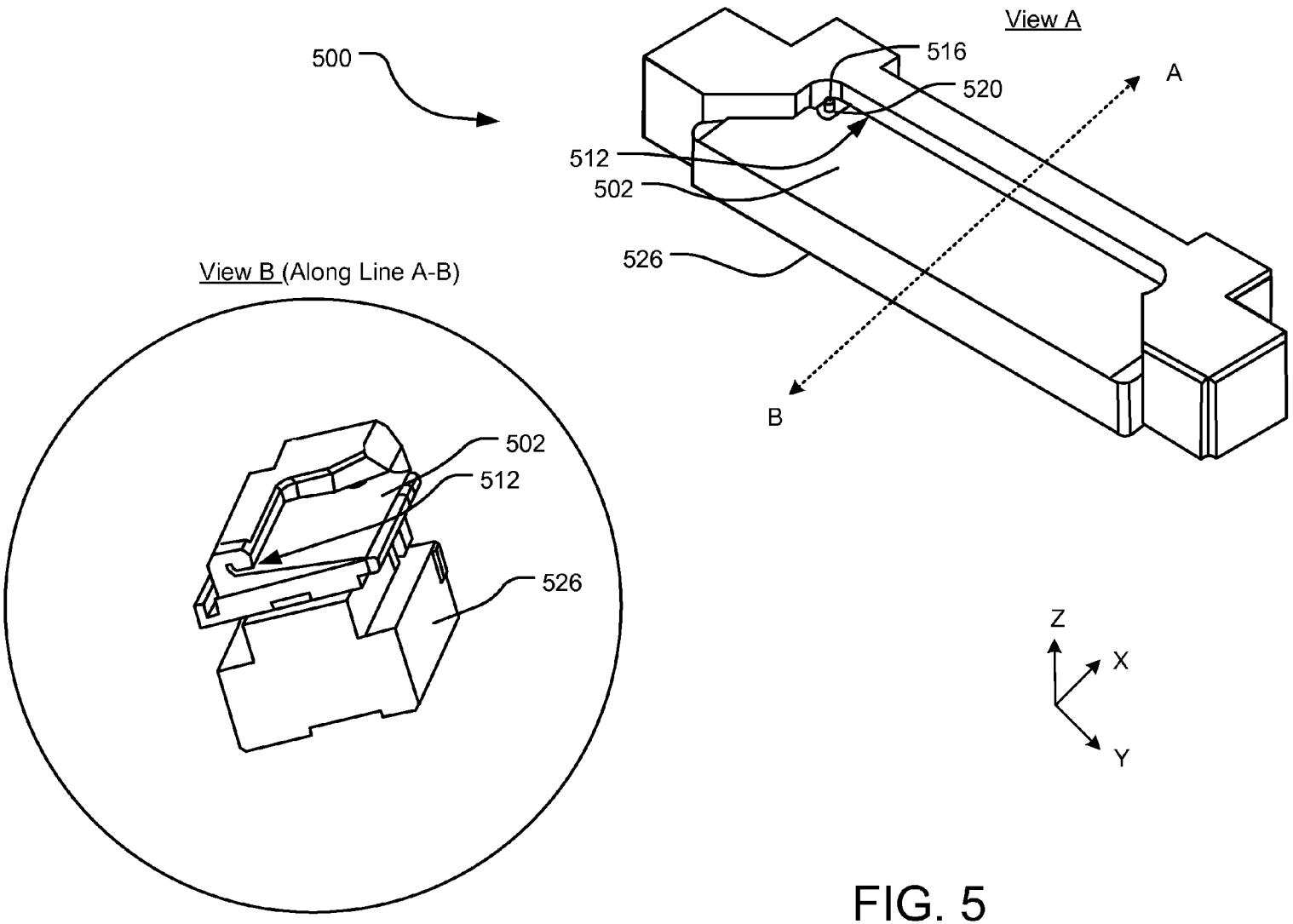
FIG. 5 illustrates a PCB with an example alignment feature attached to another example lapping carrier.

FIG. 5 illustrates a printed circuit board (PCB) 502 attached to another example lapping carrier 500. The PCB 502 includes at least one holding slot 512 (e.g., an example clamping mechanism) in a body 526 of the lapping carrier 500. The holding slot 512 is sized to receive an edge portion of the PCB 502. View B illustrates a cross-sectional view of the lapping carrier 500 taken across the axis A-B, as shown in View A. The holding slot 512 curves upward (e.g., upward, in the positive z-direction) to firmly grip an edge of the PCB 502 spanning the longitudinal axis of the PCB 502. This gripping force presses the center portion of the PCB 502 down toward the lapping carrier 500. In another implementation, the holding slot 512 curves downward (e.g., downward, in the negative z-direction). The holding slot 512 may be narrow enough that the PCB 502 cannot freely slide in and out of the holding slot 512 without an applied force (e.g., a force applied by a tool or hand of an operator).

In another implementation, the holding slot 512 has a mechanism (e.g., turn crank, nut and bolt, etc.) for adjusting the width of the holding slot 512. Thus, the width of the holding slot 512 can be reduced to secure the PCB 502 into place after the PCB 502 is positioned within the holding slot 512. In one implementation, the holding slot 512 is curved so as to provide a force to firmly secure the PCB.

The lapping carrier 500 includes at least one alignment pin 516 that aligns the PCB 502 to a position that enables a wire bonding process with a work piece (not shown). The alignment pin 516 secures the PCB 502 from lateral movement (e.g., movement in the X-Y plane) during a subsequent lapping process. To align the PCB 502 to the position that enable the wire bonding process, the alignment pin 516 is threaded through a corresponding hole 520 in the PCB 502. The alignment pin 516 may be non-removeably attached to the body 526 of the lapping carrier 540, or the alignment pin 516 may be a removable pin that is inserted through the hole in the PCB 502 and a corresponding hole in the body 526 of the lapping carrier 500.

Figure 6:
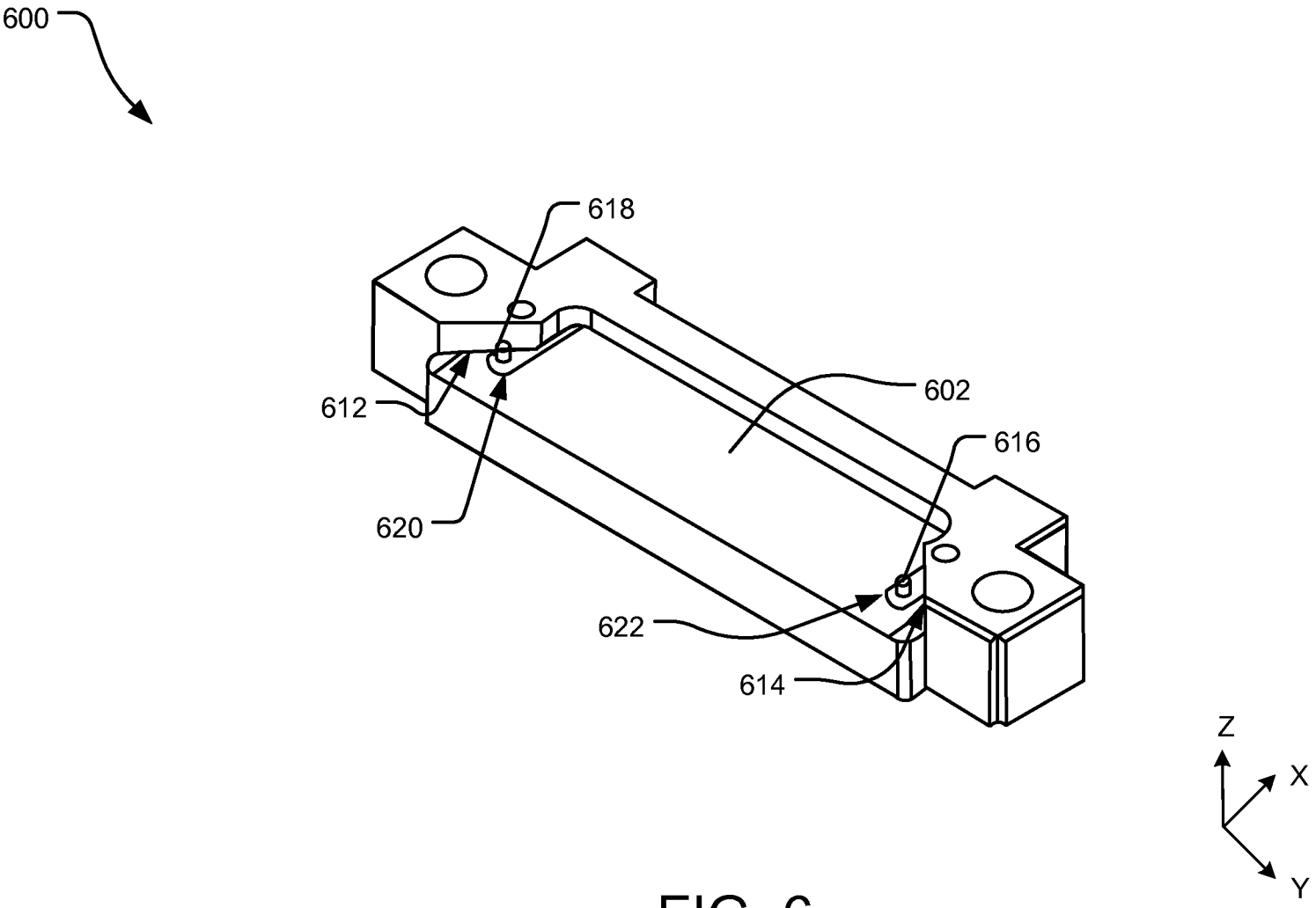
FIG. 6 illustrates another PCB with another example alignment feature attached to another example lapping carrier.

FIG. 6 illustrates a PCB 602 attached to another example lapping carrier 600. The PCB 602 includes two holding slots 612 and 614 to receive and secure "ears" (e.g., flanges) of the PCB 602. In one implementation, the holding slots 612 and 614 are narrow enough that the flanges cannot freely slide in and out of the holding slots 612 and 614 without an applied force (e.g., a force applied by a tool or hand of an operator). In another implementation, the lapping carrier includes one or more mechanisms (e.g., turn crank, nut and bolt, etc.) for adjusting the width of the holding slots 612 and 614. Thus, the width of the holding slots 612 and 614 can be reduced to secure the PCB 602 into place on the lapping carrier 600. In still another implementation, one or both of the holding slots 612 and 614 are curved so as to provide a force to firmly secure the PCB. For example, the holding slots 612 and 614 may curve upward or downward (e.g., in the positive or negative z-direction). When the PCB 602 is inserted the holding slots 612 and 614, the curvature of the slots causes the edges of the PCB 602 become firmly gripped, holding the center of the PCB 602 flat against the lapping carrier 600.

Alignment pins 616 and 618 secure the PCB 602 laterally (e.g., in the X-Y plane) to enable the formation of delicate wire bonds between the PCB 602 and a work piece (not shown). Additionally, the alignment pins 616 and 618 may prevent lateral movement (e.g., in the x-y plane) of the PCB 602 during a subsequent lapping process. In one implementation, the alignment pins 616 and 618 are non-removeably attached to a body 626 of the lapping carrier 600. In another implementation, the alignment pins 616 and 618 are detachable pins that can each be inserted a corresponding hole (e.g., a hole that is etched, drilled, milled, etc.) in the body of the lapping carrier 600. The PCB 602 has notches 620 and 622, each sized and shaped to receive the corresponding alignment pin 616 or 618.

Figure 7:
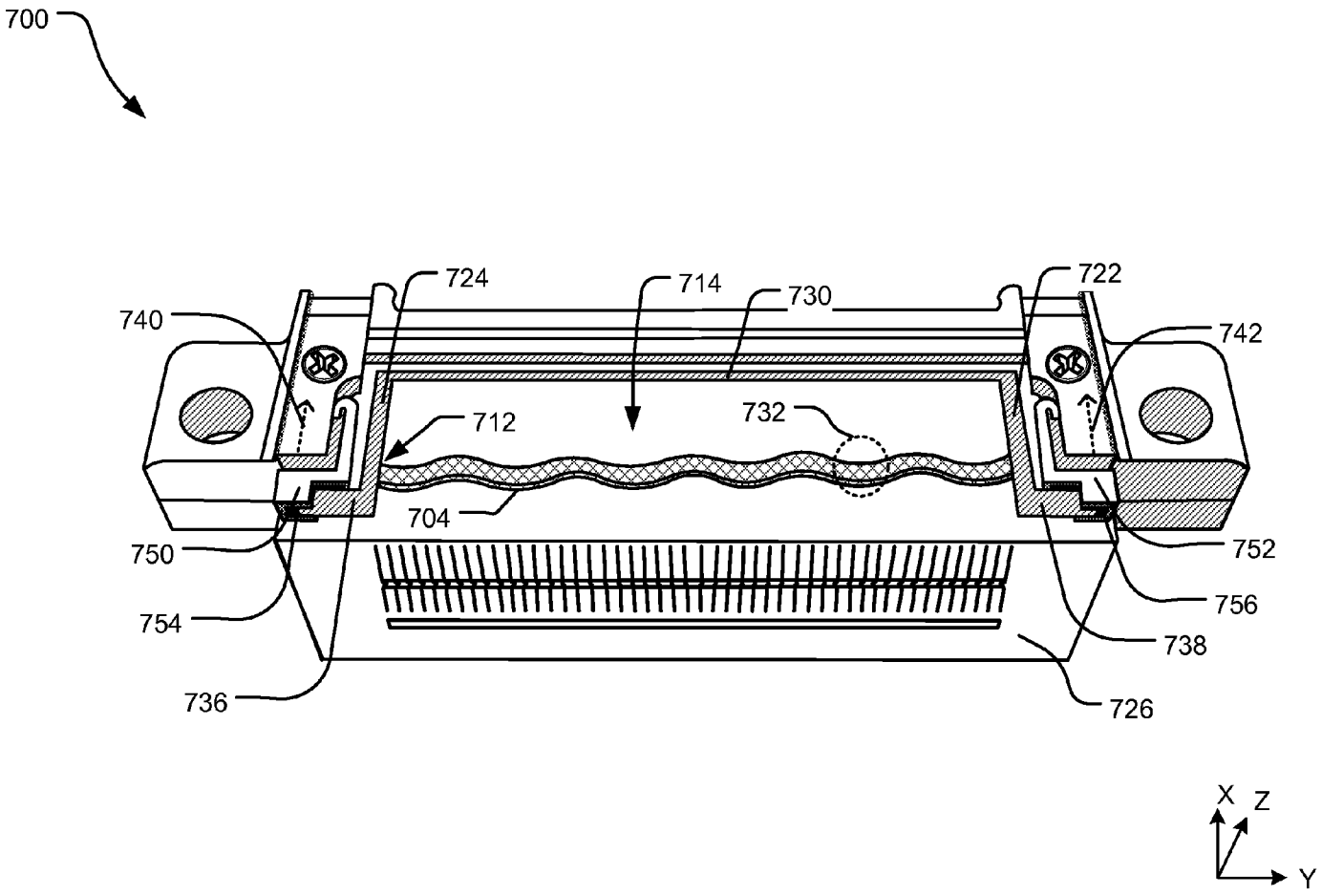
FIG. 7 illustrates an example lapping carrier with a clamping mechanism in a closed position.

FIG. 7 illustrates an example lapping carrier 700 with a clamping mechanism 712 in a closed position. The clamping mechanism 712 can be used to removeably secure a PCB (not shown) to a surface 714 of the lapping carrier 700. In FIG. 7, the clamping mechanism 712 is a mechanical clamp that includes a clamping rod 704 extended between and connected to proximal ends of supporting elements 722 and 724. Ends of the supporting elements 722 and 724 distal to the clamping rod 704 are attached to opposing ends of a pivot element 730. The pivot element 730 is moveably fastened to a body 726 of the lapping carrier 700 such that the clamping rod 704 and support elements 722 and 724 can pivot around the pivot element 730. In one implementation, the pivot element 730 includes a rod or pins sized to nest within corresponding holes (not shown) in the body 726.

In FIG. 7, the clamping rod 704 is bent in several places. Some of the bends are angled in a first direction away from the surface 714 and some of the bends are angled an opposite direction toward the surface 714. Consequently, the clamping rod 704 has five evenly spaced curving contact sections (e.g., a curving contact section 732) ensuring five points of contact with the PCB when the clamping mechanism 712 is in a closed position. In operation, the curving contact portions of the clamping rod 704 hold the PCB flat against the lapping carrier, preventing warping of the PCB. Other numbers of curving contact portions may be employed.

Slots 754 and 756, formed in clamp securing tabs 750 and 752, secure latching arms 736 and 738 of the clamping mechanism 712 in the closed position. Pressure can be applied to slide the clamp securing tabs 750 and 752 in the direction indicated by arrows 740 and 742 to release the latching arms 736 and 738 from the slots 754 and 756, permitting the clamping rod 704 to pivot freely about a pivot element 730. Such pressure can be applied, for example, manually by an operator's hand, tool, etc.

In one implementation, internal springs are positioned proximal to each of the clamp securing tabs 750 and 752 (e.g., underlying the corresponding arrows 740 and 742, respectively). The internal springs are compressed when the clamp securing tabs 750 and 752 slides in the direction of the arrows 740 and 742 to allow the clamping mechanism 712 to be opened.

Figure 8:
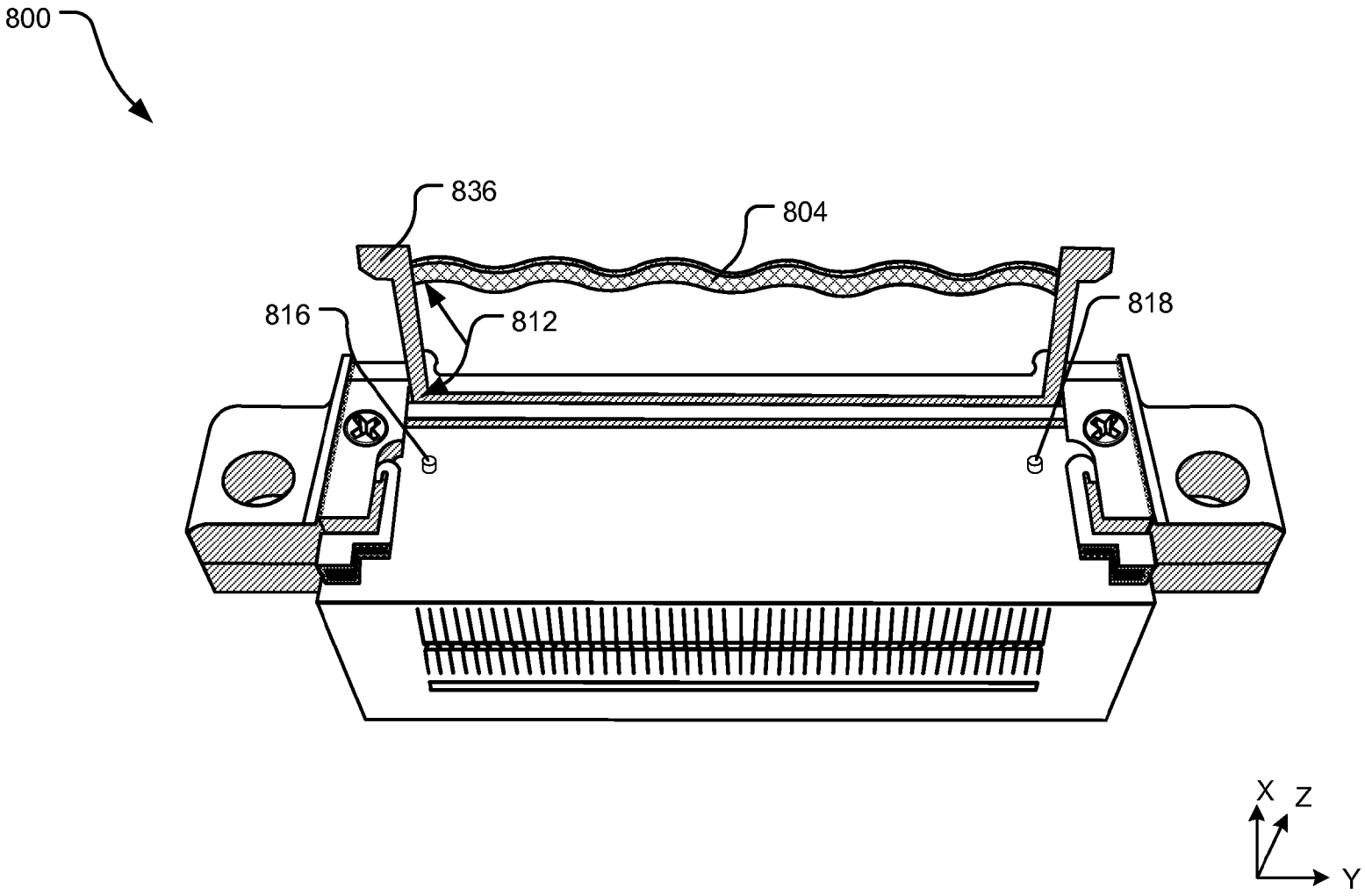
FIG. 8 illustrates another example lapping carrier with a clamping mechanism in an open position.

FIG. 8 illustrates an example lapping carrier 800 with a clamping mechanism 812 in an open position. The clamping mechanism 812 is pivotably attached to the lapping carrier 800 and configured to pivot between a first, closed position (e.g., as in FIG. 7) and a second open position (as illustrated in FIG. 8).

In FIG. 8, alignment pins 816 and 818 are visible. The alignment pins 816 and 818 are small protrusions formed on the surface 814 of the lapping carrier 800, sized and shaped to thread within a corresponding alignment hole in a PCB. Other features of the lapping guide 800 may be the same or similar to FIG. 7.

Figure 9:
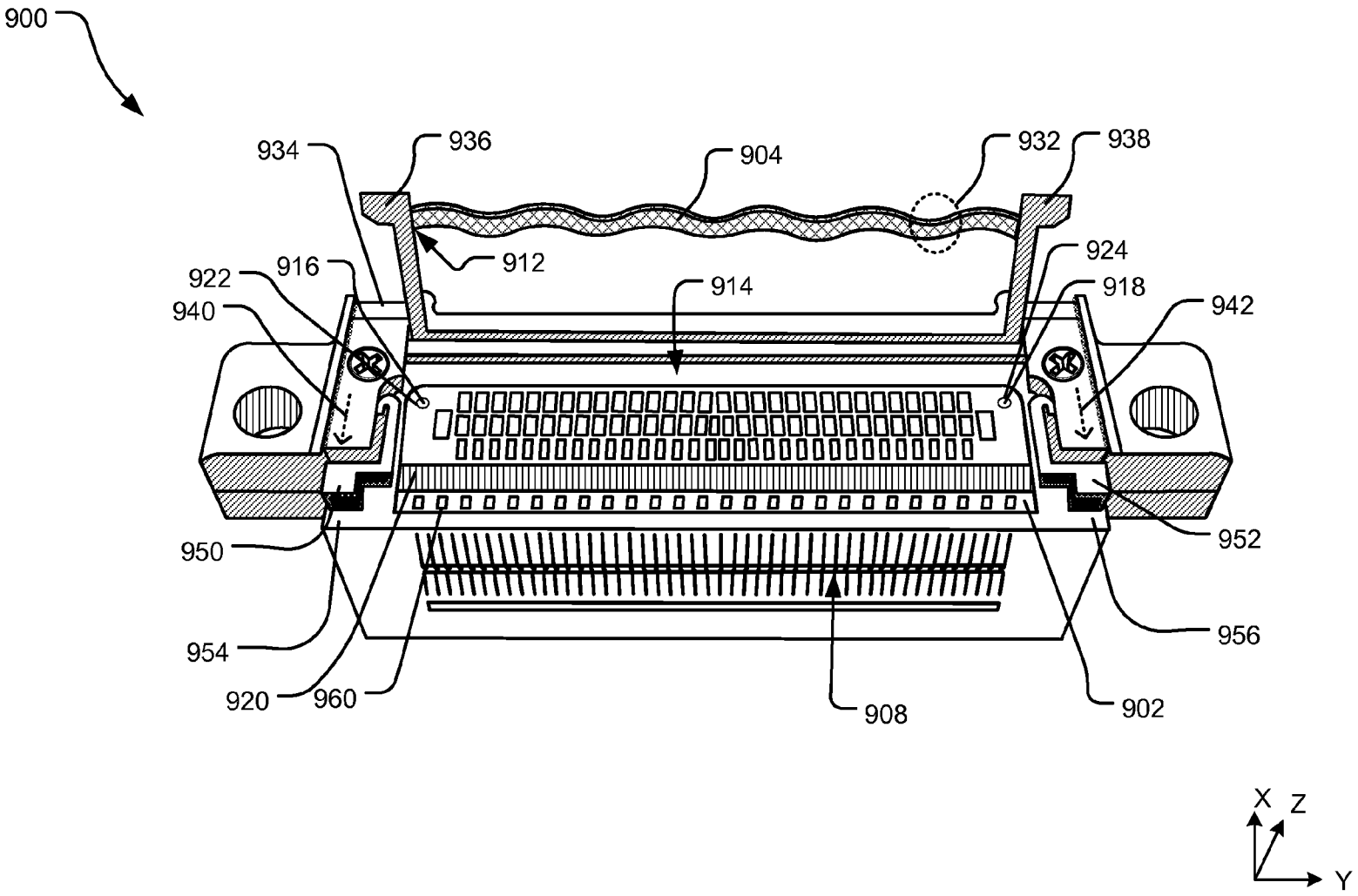
FIG. 9 illustrates a PCB positioned on another example lapping carrier that has a clamping mechanism in an open position.

FIG. 9 illustrates another example lapping carrier 900 with a clamping mechanism 912 in an open position. A PCB 902 is aligned and positioned adjacent a surface 914 of the lapping carrier 900 so that PCB bonding pads (e.g., a PCB bonding pad 960) of the PCB 902 each align with corresponding ELG bonding pads of a work piece (not shown), which may be mounted on a surface 908 of the lapping carrier 900. To align the PCB 902 relative to a desired position on the lapping carrier 900, alignment pins 916 and 918 are threaded through corresponding alignment holes 922 and 924 in the PCB 902.

A protective strip 920 is attached to the PCB 902 and serves as a landing site for the clamping rod 904 of the clamping mechanism 912. The protective strip 920 is formed of an electrically insulating material and located proximal to the PCB bonding pads. It one implementation, the protective strip 920 is positioned at a distance of between about 0.43 millimeters plus or minus 0.30 millimeters from the PCB bonding pads. When in the closed position, a clamping rod 904 of the lapping carrier contacts the protective strip 920 at each of a number of curving contact portions (e.g., a curving contact portion 932). Such contact points hold the PCB 902 flat near the PCB bonding pads to prevent warping of the PCB 902 which could prevent effective wire bonding between the PCB 902 and the work piece.

Other features of the lapping carrier 900 may be the same or similar to those described with respect to FIGS. 7 and 8.

The clamping mechanism can be closed by pressing down the clamping rod 904 against the protective strip 920 while shifting clamp securing tabs 950 and 952 in the direction of arrows 940 and 942. As the clamp securing tabs 950 and 952 slides, latching arms 936 and 938 of the clamping mechanism 912 nest into corresponding slots 954 and 956 under the clamp securing tabs 950 and 952, pinning the clamping mechanism 912 in a closed position. According to one implementation, applying a force to shift the clamp securing tabs 950 and 952 in a first direction (e.g., a direction opposite the arrows 940 and 942) compresses one or more internal springs. Releasing such force reduces the tension in the springs, allowing the clamp securing tabs 950 and 952 to shift back to an original position occupied prior to the application of the force. When in an original position and no force is applied, the clamp securing tabs 950 and 952 hold down the latch arms 936 and 938.

Figure 10:
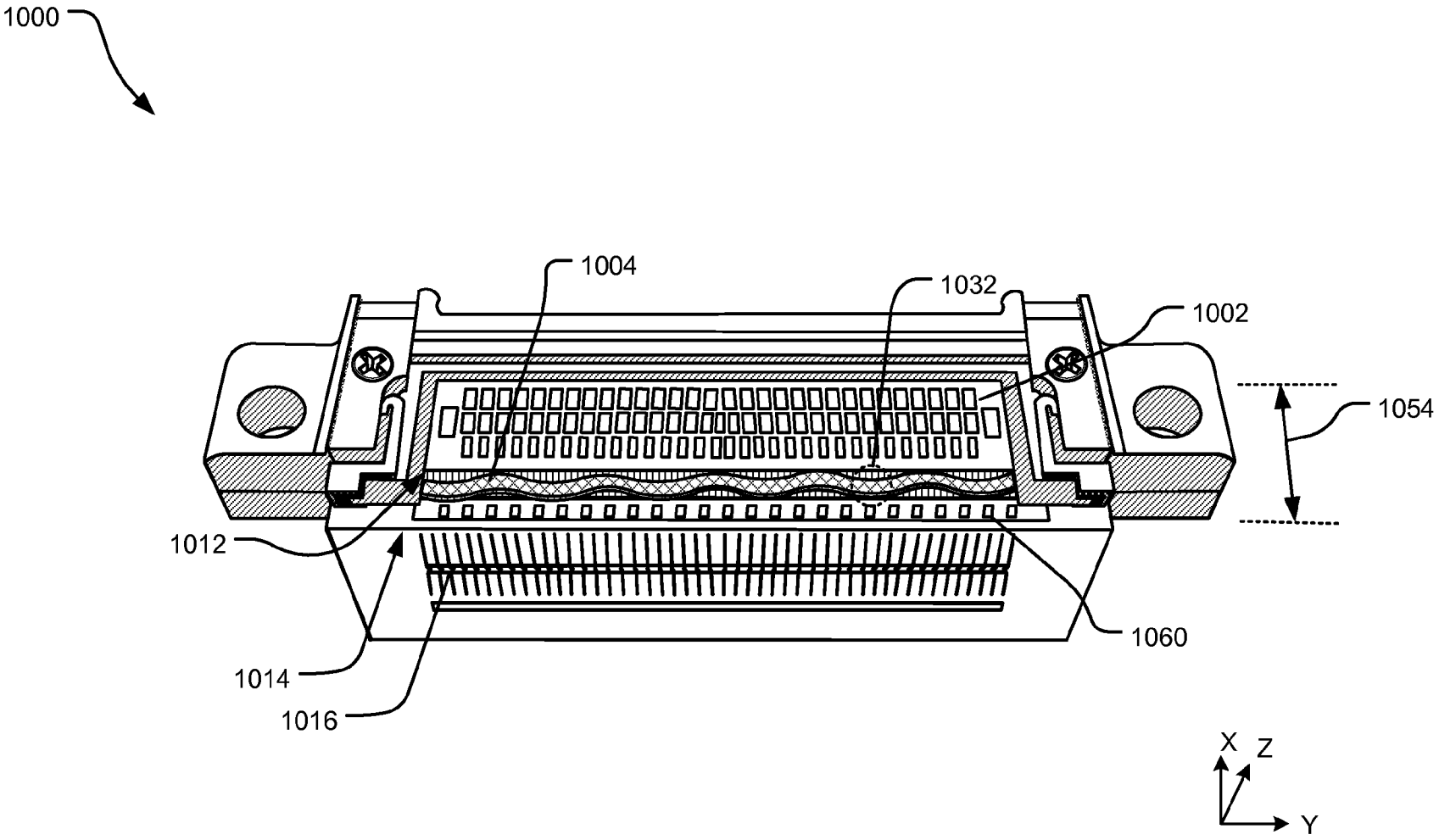
FIG. 10 illustrates another example lapping carrier with a clamping mechanism in a closed position.

FIG. 10 illustrates another example lapping carrier 1000 with a clamping mechanism 1012 in a closed position. The clamping mechanism 1012 includes a clamping rod 1004 bent in several places to create five curving contact portions (e.g., a curving contact portion 1032) that each apply pressure to a PCB 1002 when the clamping mechanism is in the closed position. The curving contact portions of the PCB clamping rod 1004 are distributed substantially evenly along the longitudinal axis of the clamping rod 1004. In one implementation, the curving contact portions are separated from one another by a distance of approximately 10 mm.

When the clamping mechanism 1012 is in the closed position (as illustrated), the clamping rod 1004 is positioned proximal to an edge 1014 of the PCB 1002 that is adjacent to a mounting surface 1016 onto which a work piece (not shown) can be mounted. In one implementation, the PCB has a total width 1054 of approximately 11.8 millimeters and the clamping rod 1004 is secured at a distance of 0.43 plus or minus 0.30 millimeters from PCB bonding pads (e.g., a PCB bonding pad 1060) on the PCB 1002 that serve as bonding sites to the work piece.

A work piece can be mounted on the mounting surface 1016 either before or after the PCB 1002 is secured (as illustrated). Once the work piece is mounted and the PCB 1002 is secured, wire bonds can be formed between the PCB bonding pads on the PCB 1002 and corresponding bonding pads of the work piece. Such bonding enables a precision lapping process that accurately planarizes a surface of the work piece.

Figure 11:
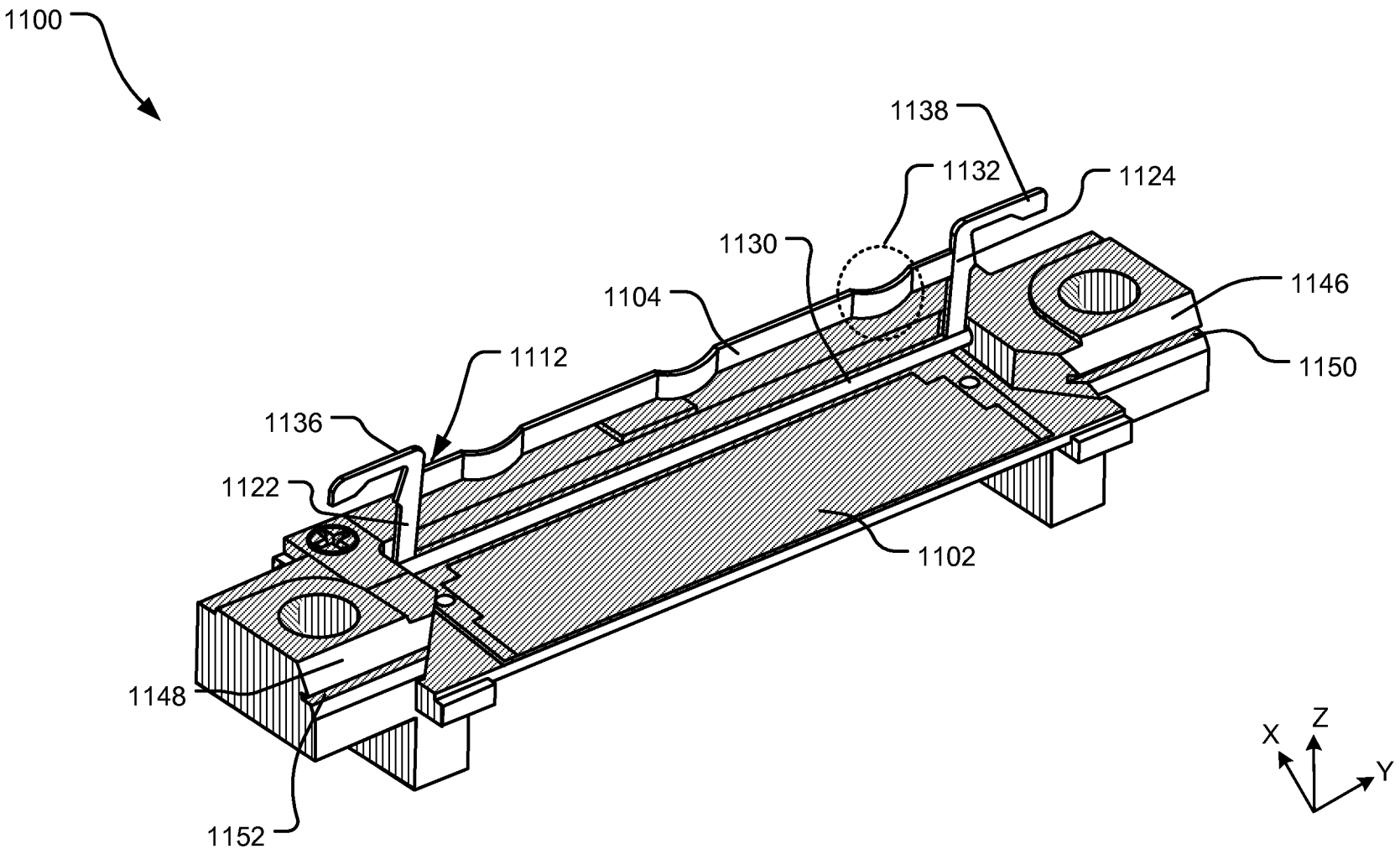
FIG. 11 illustrates another example lapping carrier with a clamping mechanism in an open position.

FIG. 11 illustrates another example lapping carrier 1100 with a clamping mechanism 1112 in an open position. The clamping mechanism 1112 includes a clamping rod 1104 that extends between proximal ends of supporting elements 1122 and 1124. Ends of the supporting elements 1122 and 1124 distal to the clamping rod 1104 are attached to opposing ends of a pivot element 1130. The clamping rod 1104 pivots about a longitudinal axis of the pivot element 1130 between a first, open position (as illustrated) and a second, closed position (e.g., as in FIG. 12).

The clamping rod 1104 is substantially planar and includes three rounded contact portions (e.g., a rounded contact portion 1132). However, other implementations may employ more or less than three rounded contact portions. The contact portions are substantially evenly spaced along the longitudinal axis of the clamping rod 1104. Further, the clamping mechanism 1112 also includes a pair of latched arms 1136 and 1138. The clamping mechanism 1112 can be placed in a closed position by applying a force on the clamping rod 1104 toward a PCB 1102. Such force causes the latched arms 1136 and 1138 to slide over corresponding sloped surfaces 1146 and 1148 before snapping into slots 1150 and 1152 and effectively locking the clamping mechanism 1112 in the closed position.

Although the latched arms 1136 and 1138 and the slots 1150 and 1152 are shown to extend horizontally (e.g., along the longitudinal axis of the lapping carrier 1100), other implementations employ latched arms that snap into angled or vertical slots in the lapping carrier 1100. Other features of the lapping carrier 1100 may be the same or similar to those illustrated and described with respect to other implementations.

Figure 12:
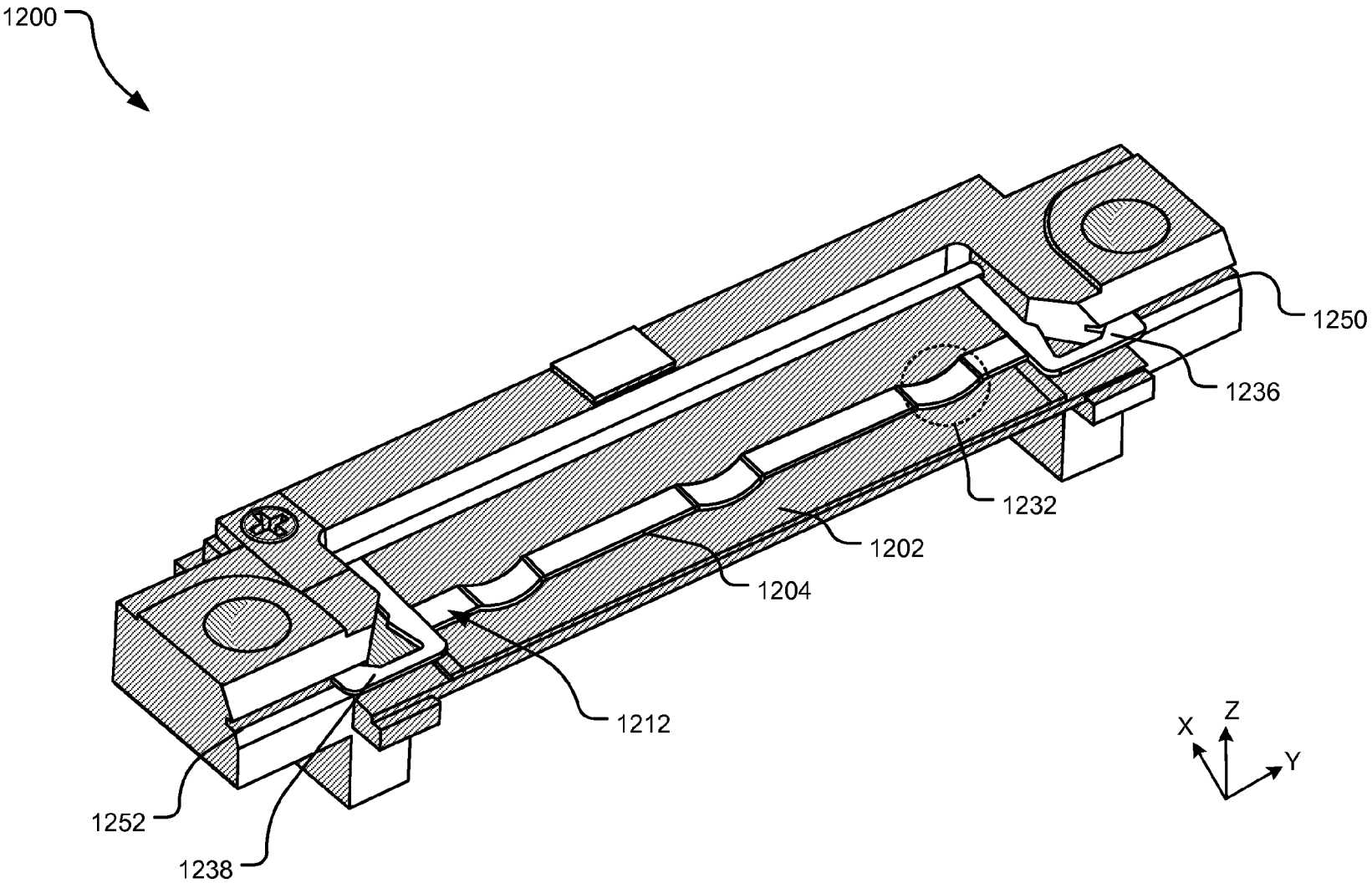
FIG. 12 illustrates yet another example lapping carrier with a clamping mechanism in closed position.

FIG. 12 illustrates another example lapping carrier 1200 with a clamping mechanism 1212 in closed position. The clamping mechanism 1212 includes a substantially planar clamping rod 1204 having three rounded contact points (e.g., a rounded contact point 1232). The rounded contact points are spaced substantially evenly along the longitudinal axis of the clamping rod 1204. Any number of such contact points is contemplated.

When the clamping mechanism 1212 is in the closed position (as illustrated), each of the rounded contact points contacts the PCB 1202 (or contacts a protective coating or strip on the PCB 1202), holding the PCB 1202 flat against the lapping carrier 1200. Latched arms 1236 and 1238 are secured into corresponding slots 1250 and 1252, respectively, of the lapping carrier 1200.

Figure 13:
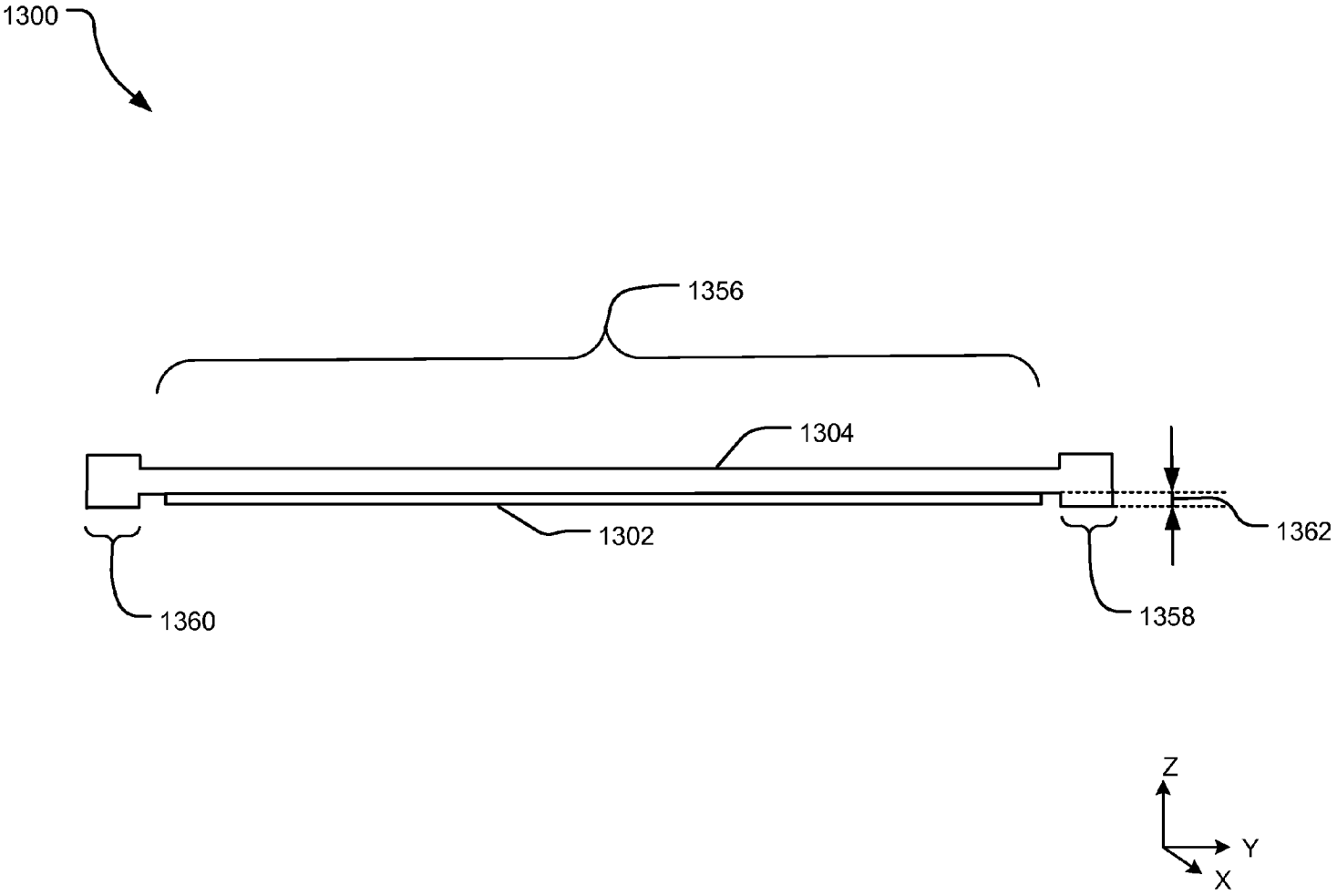
FIG. 13 illustrates another example clamping rod suitable for use in a lapping carrier.

FIG. 13 illustrates an example clamping rod 1304 suitable for use in a lapping carrier. Portions 1358 and 1360 at both ends of the clamping rod 1304 have increased diameter as compared to a central portion 1356 of the clamping rod 1304. When in use in an example lapping carrier (not shown), a PCB 1302 may be secured, as illustrated, beneath the central portion 1356 of the clamping rod 1304 such that the end portions 1358 and 1356 do not contact the PCB 1302.

In one example implementation, a difference 1362 between a radius of the central portion 1356 and the radius of the end portions 1358 and 1360 is slightly smaller than the thickness of the PCB 1302 so as to ensure even or substantially even contact along the entire longitudinal axis of the PCB 1302.

In one example implementation, the difference 1362 between the radius of the end portions 1358 and 1360 and the radius of the central portion 1356 is between approximately 440 and 450 microns. The thickness (e.g., z-direction thickness) of the PCB 1302 (e.g., including a protective strip of electrically insulating material) is about 472 microns.

Figure 14:
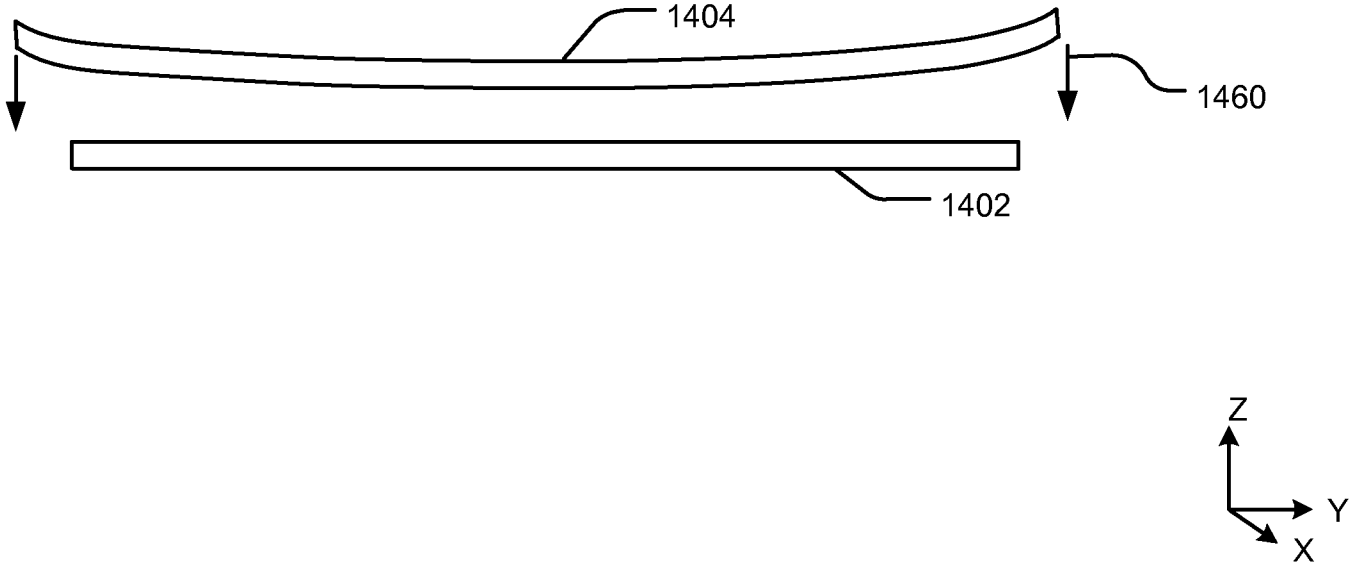
FIG. 14 illustrates an example curved clamping rod suitable for use in a lapping carrier.

FIG. 14 illustrates an example curved clamping rod 1404 suitable for use in a lapping carrier (not shown). When in use in an example lapping carrier (not shown) and unsecured (e.g., in an open position), the curved clamping rod 1404 is bent upward at both ends (e.g., bent in a slight u-shape in the z-direction) away from a PCB 1402.

When the clamp is secured against the PCB 1402 (e.g., moved in the direction of the arrow 1460 to a final "closed" position), the clamping rod 1404 contacts the PCB 1402 along substantially the entire length of the clamping rod's longitudinal axis. However, such pressure may cause the curved clamping rod 1404 to bend in into the x-y plane (e.g., into the page).

Figure 15:
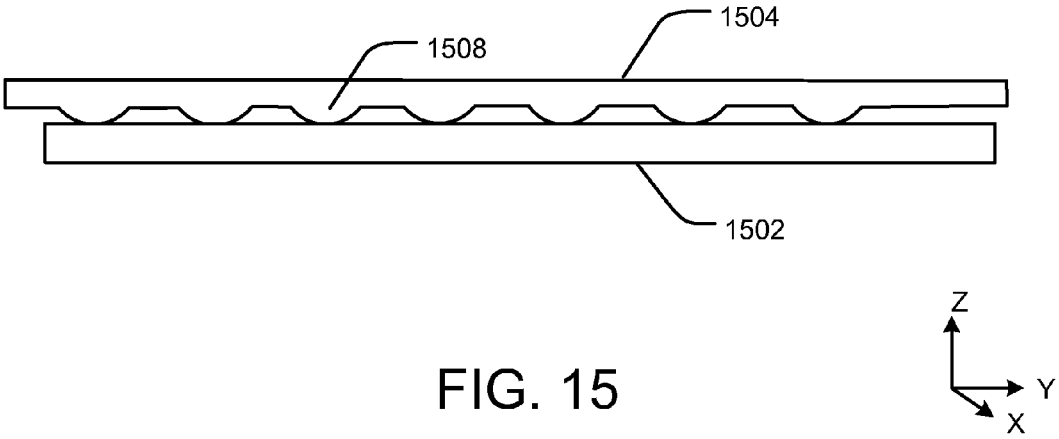
FIG. 15 illustrates another example clamping rod suitable for use in a lapping carrier.

FIG. 15 illustrates another example clamping rod 1504 suitable for use in a lapping carrier (not shown). The clamping rod 1504 is shown adjacent to a PCB 1502, and includes bumps (e.g., a bump 1508) of equal or intentionally varied height.

Figure 16:
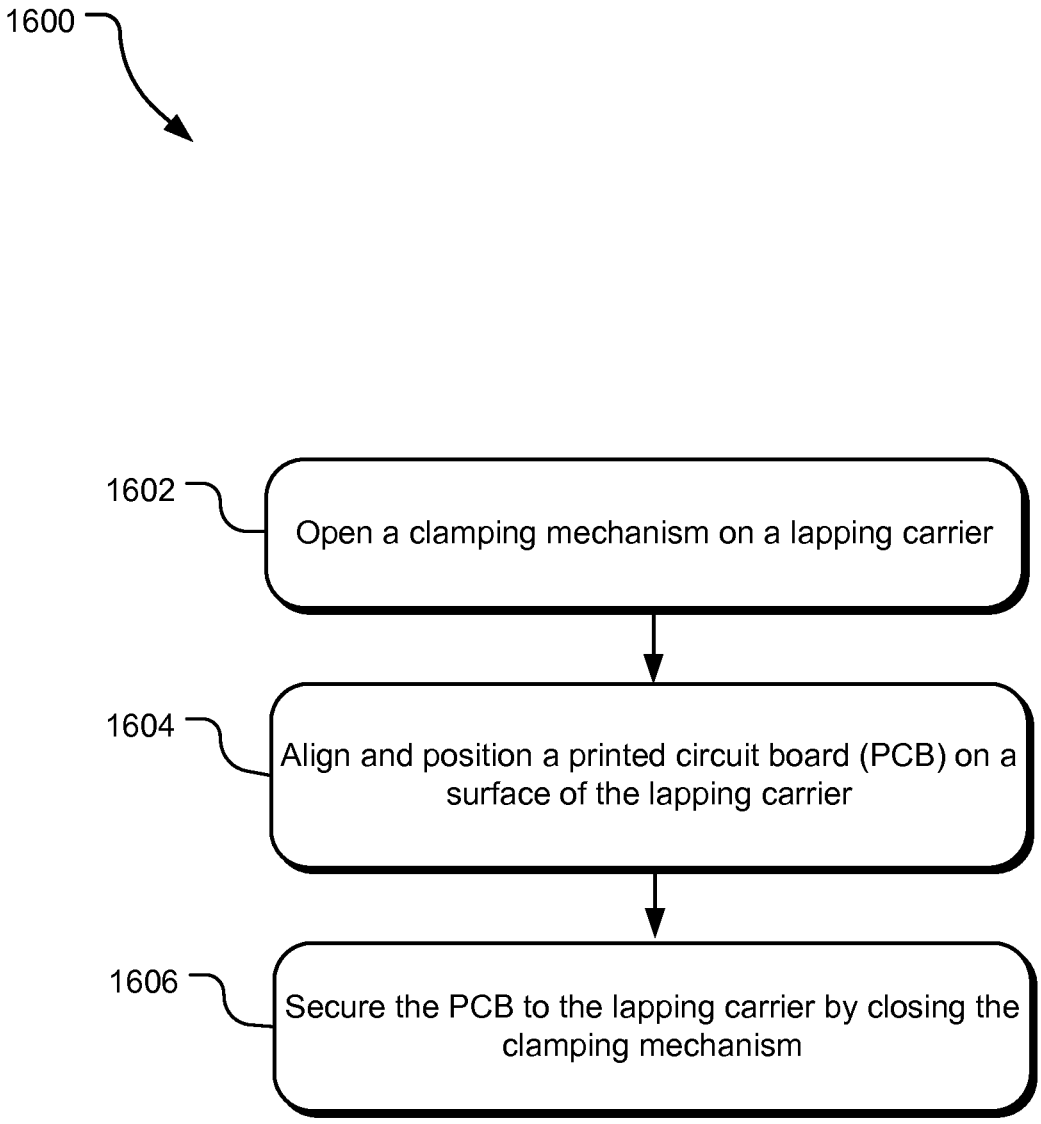
FIG. 16 illustrates example operations for securing a PCB on a lapping carrier prior to a wire bonding process.

FIG. 16 illustrates example operations for securing a PCB onto a lapping carrier prior to a wire bonding process with a work piece. An opening operation 1602 opens a clamping mechanism on a lapping carrier. The clamping mechanism may be opened manually (e.g., by an operator's hand or hand-held tool) or by a machine. According to one implementation, the clamping mechanism includes a clamping rod that spans across a longitudinal axis of a PCB when the PCB is secured to the lapping carrier. The clamping rod may be a variety of different shapes including round (e.g., a cylindrical bar), flat (e.g., planar), curved (e.g., u-shaped) and/or wavy (e.g., having several bends). In one implementation, the clamping rod has a variable diameter. In some implementations, the clamping mechanism does not include a clamping rod. For example, the clamping rod may include one or more slots that each receives a portion of the PCB.

The opening operation 1602 may be performed in a variety of ways. In one implementation, the opening operation 1602 applies a force to a sliding clamp holder or clamp securing tabs to compress a spring and release a clamping rod from a secured position. Once released, the clamping rod may pivot about an axis. In another implementation, a wedged tool is used to wedge open a pair of spring plates. In at least one implementation, the pressure applied to the lapping carrier during the opening operation 1602 is applied throughout an alignment and positioning operation 1604. Such pressure may be removed during a subsequent securing operation 1606, described below.

In yet another implementation, the opening operation 1602 engages one or more mechanical toggles or switches to release a clamping rod so that the clamping rod may pivot about the axis. For example, a toggle or switch may be engaged to release one or more compressed springs, forcing the clamping mechanism open.

While the clamping mechanism is in the open position, an alignment and positioning operation 1604 aligns a PCB on a surface of the lapping carrier and positions the aligned PCB on the surface. In one implementation, the alignment and positioning operation 1604 includes aligning one or more features of the PCB with one or more features on the lapping carrier. For example, one or more alignment pins on the lapping carrier may be aligned with one or more corresponding holes in the PCB, and the alignment pins may be threaded through one or more of the corresponding holes in the PCB. In another implementation, the alignment and positioning operation includes threading one or more pins that are separate from the lapping carrier through holes on both of the PCB and the lapping carrier.

A securing operation 1606 secures the PCB to the lapping carrier by closing the clamping mechanism. In one implementation, the securing operation 1606 closes the clamping mechanism by removing a force applied during the opening operation 1602 (e.g., a force applied to pry open a spring plate, slide a spring-loaded clamp holder, etc.). In other implementations, the securing operation 1606 closes the clamping mechanism by applying a force. For example, a user may push down a clamping rod against the PCB to compress a spring, and turn a toggle or other switch to secure the clamping rod in place. In yet another implementation, the securing operation 1506 closes the clamping mechanism by pressing one or more latched arms of the clamping mechanism into corresponding slots in the lapping carrier.

In one or more implementations, electrical paths of the PCB are protected from damaging contact with the clamping mechanism. For example, a protective strip of electrically insulating material may serve as a landing site for a clamping rod. Alternatively, the clamping rod may be made of or coated with an electrically insulating material.

The specific steps discussed with respect to each of the implementations disclosed herein are a matter of choice and may depend on the materials utilized and/or design criteria of a given system. The above specification, examples, and data provide a complete description of the structure and use of exemplary implementations of the invention. Since many implementations of the invention can be made without departing from the spirit and scope of the invention, the invention resides in the claims hereinafter appended.

What is claimed is:

1. Apparatus comprising:

an alignment mechanism to align a PCB relative to a lapping carrier; and a clamping mechanism to secure the PCB to the lapping carrier, the clamping mechanism extending across the PCB when the clamping mechanism is secured.

2. The apparatus of claim 1, wherein the clamping mechanism is electrically insulated from contact with electrical paths of the PCB.

3. The apparatus of claim 1, wherein the clamping mechanism applies pressure along a length of the PCB to hold the PCB flat against a surface of the lapping carrier.

4. The apparatus of claim 1, wherein the alignment mechanism includes at least one pin to pass through a hole on the PCB.

5. The apparatus of claim 1, wherein the clamping mechanism includes a clamping rod.

6. The apparatus of claim 5, wherein the clamping rod has a variable diameter.

7. The apparatus of claim 5, wherein the clamping rod has bends in first direction and bends in a second direction opposite the first direction, the bends in the first direction corresponding to regions that do not contact the PCB when the clamping mechanism is secured.

8. The apparatus of claim 5, wherein the clamping rod has a sufficient length to extend across the entire PCB.

9. The apparatus of claim 5, wherein the clamping mechanism includes the clamping rod and at least one of a tension spring, a compressive spring, spring plates, torsion springs, latching arms, and mechanical toggles.

10. The apparatus of claim 1, wherein the clamping mechanism extends across the entire PCB.

11. Apparatus comprising:

a lapping carrier having a surface to receive a PCB;

an alignment mechanism to align the PCB relative to the surface; and a clamping mechanism extending across the surface to secure the PCB against the surface of the lapping carrier.

12. The apparatus of claim 11, wherein the clamping mechanism extends across the entire surface.

13. The apparatus of claim 11, wherein the clamping mechanism includes a clamping rod.

14. The apparatus of claim 13, wherein the clamping rod has a sufficient length to extend across the entire surface.

15. The apparatus of claim 13, wherein the clamping mechanism further comprises at least one of a tension spring, a compressive spring, spring plates, torsion springs, latching arms, and mechanical toggles.

16. The apparatus of claim 13, wherein the clamping rod has a variable diameter.

17. The apparatus of claim 13, wherein the clamping rod comprises electrically insulating material.

18. The apparatus of claim 11, wherein the alignment mechanism includes at least one pin extending from the surface.

19. Apparatus comprising:

a lapping carrier having a surface to receive a PCB;

an alignment pin extending from the surface; and a clamping mechanism extending across the surface to secure the PCB against the surface of the lapping carrier.

20. The apparatus of claim 19, wherein the clamping mechanism includes a clamping rod.

* * * * *